US009333767B2

(12) United States Patent
Yamasaki

(10) Patent No.: US 9,333,767 B2
(45) Date of Patent: May 10, 2016

(54) DRAWING APPARATUS AND DRAWING METHOD OF DRAWING APPARATUS

(71) Applicant: CASIO COMPUTER CO., LTD., Shibuya-ku, Tokyo (JP)

(72) Inventor: Shuichi Yamasaki, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/743,185

(22) Filed: Jun. 18, 2015

(65) Prior Publication Data

US 2015/0375525 A1 Dec. 31, 2015

(30) Foreign Application Priority Data

Jun. 30, 2014 (JP) ..... 2014-133594

(51) Int. Cl.
*B41J 29/38* (2006.01)
*B41J 3/407* (2006.01)

(52) U.S. Cl.
CPC ..... *B41J 3/4073* (2013.01)

(58) Field of Classification Search
CPC ..... B41J 3/4073
USPC ..... 347/16
See application file for complete search history.

(56) References Cited

U.S. PATENT DOCUMENTS 6,280,517 B1 * 8/2001 Ogawa ..... B05D 1/185 106/287.16
6,286,517 B1 9/2001 Weber et al.
2014/0060560 A1 * 3/2014 Bitoh ..... A45D 29/00 132/73

FOREIGN PATENT DOCUMENTS

JP 2003534083 A 11/2003

* cited by examiner

*Primary Examiner* — Jason Uhlenhake
(74) *Attorney, Agent, or Firm* — Holtz, Holtz & Volek PC

(57) ABSTRACT

A drawing apparatus and drawing method to perform drawing on a drawing target region are shown. The drawing apparatus includes a drawing unit and a control unit. The drawing target region is a surface of a plurality of nails and the nails include unit regions in contact with each other to be drawn with ink in different colors. The control unit includes a nail specifying unit which judges whether each of the unit regions is a dried unit region, a non-dried unit region, and a non-drawn unit region. Then, the nail specifying unit extracts the non-drawn unit region which is not in contact with the non-dried unit region as a specific unit region. The control unit also includes a drawing control unit which controls the drawing unit to perform the drawing on the specific unit region.

18 Claims, 8 Drawing Sheets

DRAWING APPARATUS AND DRAWING METHOD OF DRAWING APPARATUS

CROSS-REFERENCE TO RELATED APPLICATIONS

The present U.S. patent application claims priority under the Paris Convention of Japanese Patent Application No. 2014-133594 filed on Jun. 30, 2014 the entirety of which is incorporated herein by reference.

BACKGROUND OF THE INVENTION

1. Field of the Invention

The present invention relates to a drawing apparatus and a drawing method used in the drawing apparatus.

2. Description of the Related Art

There is a conventionally known ink-jet printer (drawing apparatus) which sprays ink from a drawing head to print a nail design on a nail. Such drawing apparatus is described in, for example, Japanese Patent Application Laid-Open Publication No. 2003-534083.

Printing on nails is easily possible at home if such drawing apparatuses are used.

However, it is difficult to eject ink including coloring material with large particle sizes as used in commercially available manicure from a drawing head of an ink-jet drawing apparatus. Therefore, there are problems such as the design that can be printed being limited or the finish not being beautiful.

It is also considered to use a plotter drawing apparatus which includes a drawing head with a writing tool such as a pen attached and an image is drawn by placing a sheet (target) to be in contact with the tip of the writing tool to draw a nail design on the nail. With such apparatus, the type of ink that can be used is not limited, and it is possible to draw on the nail a nail print similar to those drawn at a nail salon.

In a drawing apparatus which draws the nail design by plotting using many colors of ink, if drawing is performed in a region next to a region where drawing is already performed with a different color ink before the ink of the region drawn before is dried, the ink may be mixed at the boundary of the regions, and the image may be blurred or the color may blur. This results in a finish which is not beautiful.

Nails on which nail prints are drawn do not absorb ink. Therefore, it takes longer to dry ink on nails than ink drawn on paper. Therefore, the image and color blurring due to different color ink mixing easily occurs.

In order to prevent blurring of the image and the color, the next color needs to be drawn after waiting for the previously colored ink to dry. Since the time waiting for the ink to dry increases, a large amount of time is consumed for drawing.

Such waiting time becoming longer results in the drawing time becoming longer. This becomes a problem when nail print is performed on a plurality of nails of a plurality of fingers, such as when nail print is performed on plurality of nails of plurality of fingers of one hand or both hands.

BRIEF SUMMARY OF THE INVENTION

The present invention has been conceived in view of the above problems, and one of the main objects is to provide a drawing apparatus and a drawing method used in a drawing apparatus in which surfaces of a plurality of nails are drawing target regions and drawing is performed with a plurality of types of ink in a plurality of regions including portions where drawing target regions in each nail are in contact with each other to prevent blurring of the image and color due to different color ink being mixed while shortening the amount of time necessary to draw on a plurality of nails.

According to an aspect of the present invention, there is provided a drawing apparatus including:

a drawing unit which applies ink to a drawing target region to perform drawing, the drawing target region is a surface of a plurality of nails of a plurality of fingers of a hand or a foot; and a control unit which controls the drawing unit to perform the drawing on the drawing target region, wherein, in the drawing target region, at least any one of the plurality of nails includes a plurality of unit regions which are in contact with each other in at least one portion;

each of the two unit regions in contact with each other is a region to be drawn with ink in different colors; and the control unit includes:

a nail specifying unit which, after the drawing unit applies ink to at least one unit region in the drawing target region, judges whether each of the plurality of unit regions is a dried unit region in which drying of the applied ink is completed, a non-dried unit region in which drying of the applied ink is not completed, or a non-drawn unit region in which the ink is not applied; extracts a specific unit region from the plurality of unit regions, wherein the specific unit region is the non-drawn unit region which are not in contact with the non-dried unit region; and specifies the nail including the specific unit region as a specific nail; and a drawing control unit which controls the drawing unit to perform the drawing on the specific unit region in the specific nail.

According to another aspect of the present invention, there is provided a drawing method of a drawing apparatus including:

wherein the drawing apparatus including a drawing unit which applies ink to a drawing target region to perform drawing, the drawing target region is a surface of a plurality of nails of a plurality of fingers of a hand or a foot, wherein, in the drawing target region, at least any one of the plurality of nails includes a plurality of unit regions which are in contact with each other in at least one portion; and each of the two unit regions in contact with each other is a region to be drawn with ink in different colors, judging, after the drawing unit applies ink to at least one unit region in the drawing target region, whether each of the plurality of unit regions is a dried unit region in which drying of the applied ink is completed, a non-dried unit region in which drying of the applied ink is not completed, or a non-drawn unit region in which the ink is not applied;

extracting a specific unit region from the plurality of unit regions, wherein the specific unit region is the non-drawn unit region which are not in contact with the non-dried unit region;

specifying the nail including the specific unit region as a specific nail; and controlling the drawing unit to perform the drawing on the specific unit region in the specific nail.

BRIEF DESCRIPTION OF THE DRAWINGS

The present invention and the above-described objects, features and advantages thereof will become more fully understood from the following detailed description with the accompanying drawings and wherein;

FIG. 4A is a side view of a writing tool carriage and a writing tool, FIG. 4B is an upper view of a writing tool carriage and a writing tool shown in FIG. 4A viewed from an arrow b direction, FIG. 4C is a front view of a writing tool carriage and a writing tool shown in FIG. 4A viewed from an arrow c direction;

DETAILED DESCRIPTION OF THE INVENTION

Figure 1:
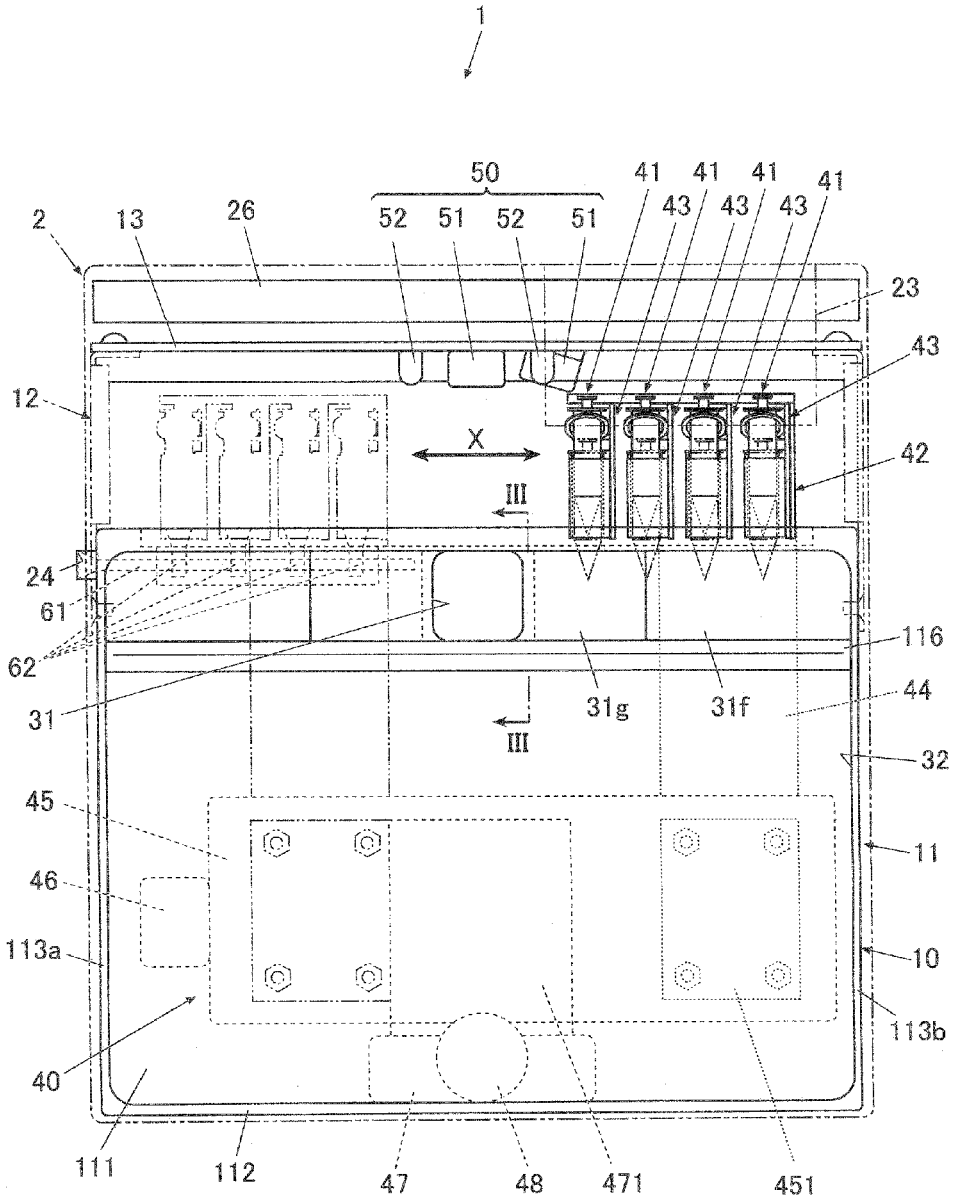
FIG. 1 is a front view of a nail print apparatus of the present embodiment.

An embodiment of a drawing apparatus of the present embodiment is described with reference to the drawings. However, the scope of the present invention is not limited to the illustrated examples.

According to the drawing apparatus of the present embodiment, a nail is inserted in the drawing apparatus one nail at a time to draw on the nail of the finger and a plurality of fingers are successively switched so that drawing is performed on the nails of the plurality of fingers successively. According to the present embodiment, the drawing apparatus is a nail print apparatus.

According to the embodiments described below, technically preferred limitations are added to implement the present invention. However, the scope of the present invention is not limited to the embodiments and the illustrated examples described below.

Figure 2:
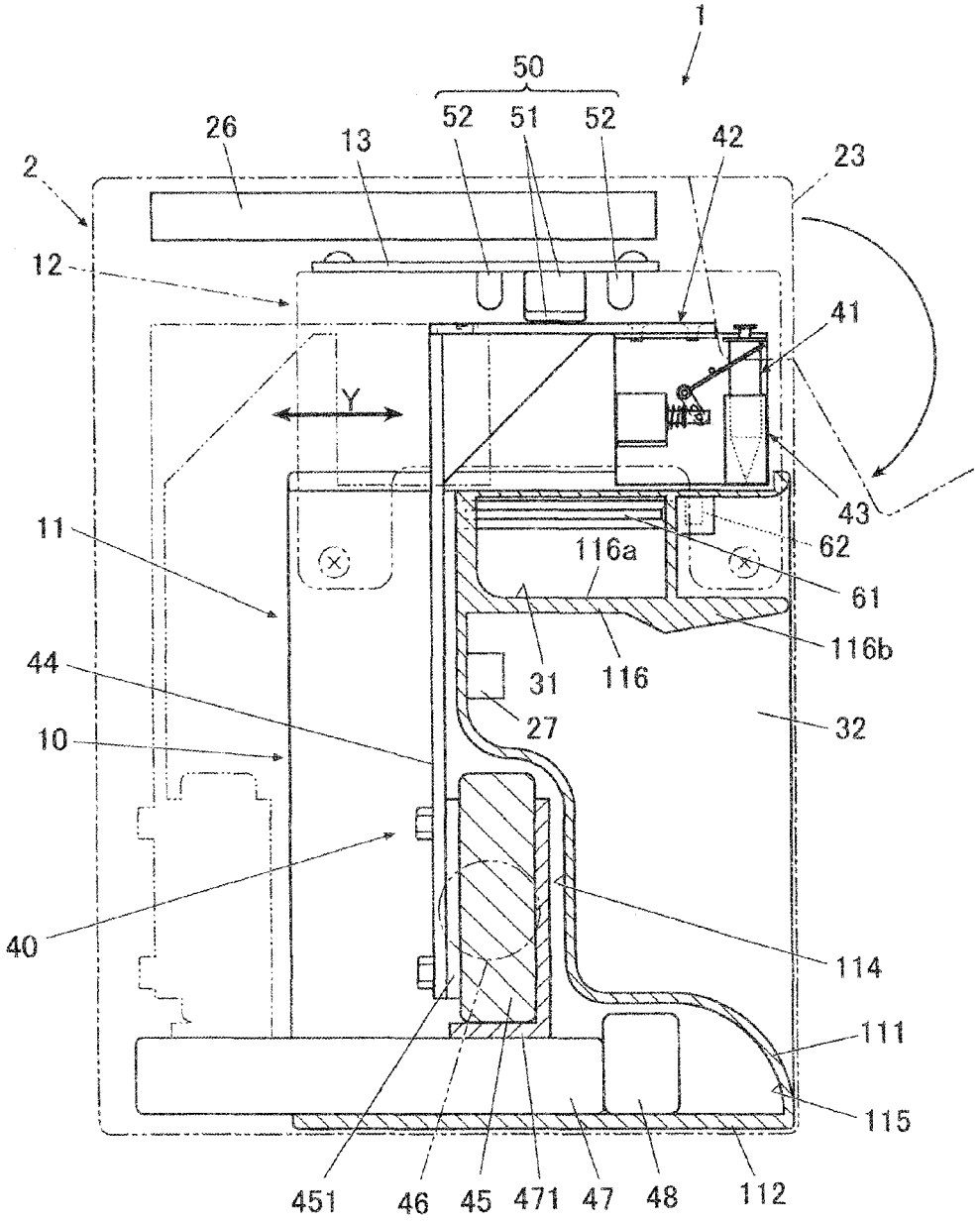
FIG. 2 is a side view showing an internal configuration from a cross sectional view of a portion of the nail print apparatus shown in FIG. 1.

FIG. 1 is a front view of the nail print apparatus, and FIG. 2 is a side view showing an internal configuration from a cross sectional view of a portion of the nail print apparatus shown in FIG. 1.

As shown in FIG. 1 and FIG. 2, a nail print apparatus 1 which is a drawing apparatus includes a case main body 2 and an apparatus main body 10 which is stored in the case main body 2. The case main body is shown with an alternate long and two short dash lines in FIG. 1 and FIG. 2.

A writing tool exchanging lid 23 is provided so as to be able to open and close in order to exchange a writing tool 41 such as a pen of a later described drawing unit 40 at one edge of an upper front face of the case main body 2. The writing tool exchanging lid 23 is able to rotate by a hinge, etc. from a closed state to an opened state as shown in FIG. 2.

A medium inserting opening 24 is formed at one side of the case main body 2 (according to the present embodiment, the left side in FIG. 1) in a position corresponding to a later described writing tool testing unit 61 to replace a drawing medium (not shown) placed in the writing tool testing unit 61.

An operating unit 25 (see FIG. 5) is provided in an upper face (top plate) of the case main body 2.

The operating unit 25 is an input unit for the user to perform various input.

For example, the operating unit 25 is provided with various operation buttons (not shown) to perform various input such as a power source switch button to turn on the power of the nail print apparatus 1, a stop switch button to stop the operation, a design selection button to select a design image to be drawn on a nail T, a drawing start button to instruct start of drawing, and the like.

A display unit 26 is provided in substantially the center portion of the upper face (top plate) of the case main body 2.

For example, the display unit 26 includes a liquid crystal display (LCD), an organic electroluminescence display or other flat display.

According to the present embodiment, the following images or screens are suitably displayed on the display unit 26, for example, a nail image obtained by capturing a print finger ha (a finger image including an image of a nail T), an image of an outline, etc. of the nail T included in the nail image, a design selection screen to select a design image to be drawn on the nail T, a thumbnail image for confirming the design, an instruction screen to display various instructions, and the like.

The touch panel is formed as one with a surface of the display unit 26. In this case, for example, various selection and instruction can be executed by touching the surface of the touch panel with the finger tip, etc. Other than a finger, various input can be performed by touching the surface of the display unit 26 with, for example, a stylus pen or other tool which is a sharp stick shape.

The apparatus main body 10 is formed in a substantial box shape and includes a lower machine frame 11 provided in a lower portion inside the case main body 2 and an upper machine frame 12 provided above the lower machine frame 11 in an upper portion inside the case main body 2.

First, the lower machine frame 11 is described.

The lower machine frame 11 includes a back face plate 111, a bottom plate 112, a pair of left and right side plates 113*a* and 113*b*, an X-direction moving stage storing unit 114, a Y-direction moving stage storing unit 115 and a partition wall 116.

A bottom edge portion of side plates 113*a* and 113*b* are each connected to both left and right edge portions of the bottom plate 112, and the side plates 113*a* and 113*b* are provided in a state standing from the bottom plate 112.

As shown in FIG. 2, the lower portion of the back face plate 111 is formed to be caved in two steps toward the front (near side in finger inserting direction). The lower edge portion of the back face plate 111 is connected to the front edge portion of the bottom plate 112, and the back face plate 111 divides the region surrounded by the bottom plate 112 and the side plates 113*a* and 113*b* into front and back.

The caved in space formed on the back side of the back face plate 111 is to be the X-direction moving stage storing unit 114 and Y-direction moving stage storing unit 115 (see FIG. 2). An X-direction moving stage 45 of the drawing unit 40 is stored when the drawing unit 40 (see FIG. 2) is moved forward (near side in finger inserting direction) in the X-direction moving stage storing unit 114. The Y-direction moving stage 47 of the drawing unit 40 is positioned in the Y-direction moving stage storing unit 115.

The partition wall 116 is provided inside the lower machine frame 11 so as to divide the space on the front side inside the lower machine frame 11 into top and bottom (space on the near side in the finger inserting direction surrounded by the back face plate 111, bottom plate 112, and side plates 113*a* and 113*b*). The partition wall 116 is provided substantially horizontal, both left and right edge portions of the partition wall 116 are respectively connected to the side walls 113*a* and 113*b*, and the back edge portion of the partition wall 116 is connected to the back face plate 111.

A finger fixing unit 30 is provided as one with the lower machine frame 11.

A finger fixing unit 30 is described with reference to FIG. 3.

Figure 3:
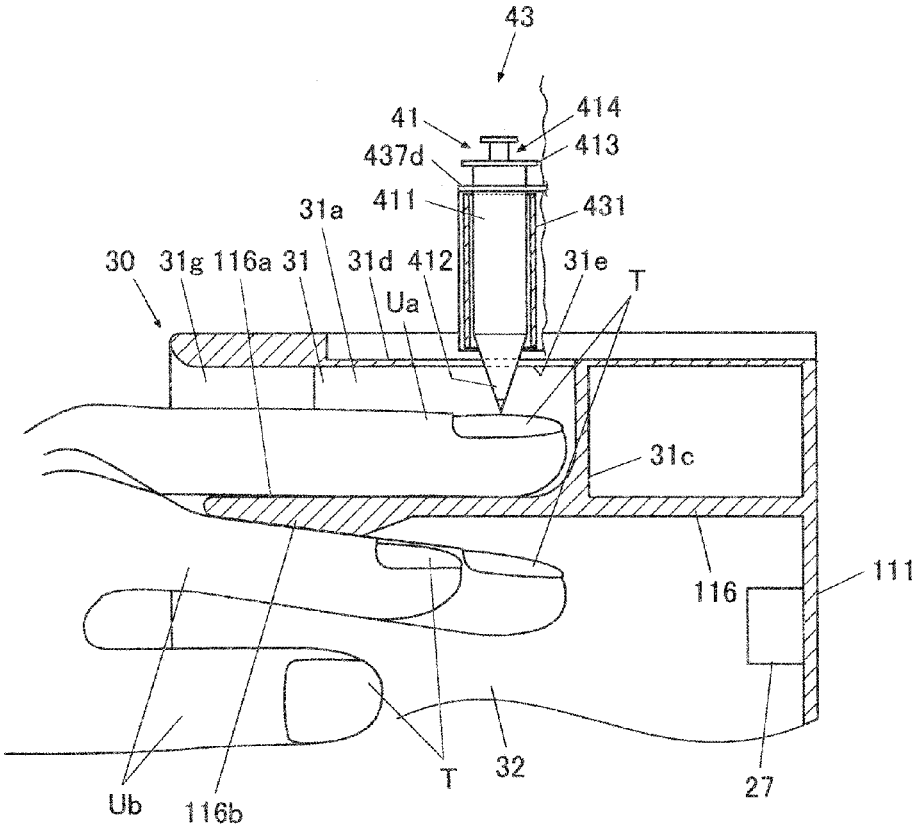
FIG. 3 is a cross sectional view along line in FIG. 1.

FIG. 3 is a cross sectional view showing the cross section along line shown in FIG. 1 viewed in the arrow direction.

The finger fixing unit 30 is composed of a finger inserting unit 31 in which the finger corresponding to the nail T on which drawing is performed (hereinafter referred to as "print finger Ua") is inserted and a finger shelter unit 32 where the fingers other than the print finger Ua (hereinafter referred to as "non-print finger Ub") are evacuated.

The finger inserting unit 31 is positioned in substantially the center in the width direction of the lower machine frame 11 on the upper side of the partition wall 116.

The space on the lower side of the lower machine frame 11 divided by the partition wall 116 composes the finger shelter unit 32.

For example, when drawing is performed on the nail T of the ring finger, as shown in FIG. 3, the ring finger as the print finger Ua is inserted in the finger inserting unit 31 and the other four fingers (thumb, index finger, middle finger, little finger) which are the non-print fingers Ub are inserted in the finger shelter unit 32.

According to the present embodiment, the print finger Ua corresponding to the nail T as the drawing object is inserted one by one in the finger inserting unit 31, the nail T is positioned in a predetermined drawing position, drawing is performed on the nail T, and with this, the finger is suitably replaced to successively draw on the plurality of nails T.

The finger inserting unit 31 is open to the front face side of the lower machine frame 11 (near side in the print finger inserting direction). The lower side is divided by a finger placing unit 116*a* which is a portion of the partition wall 116, both sides are divided by partition 31*a*, and the far side is divided by the partition 31*c*. The finger placing unit 116*a* is where the finger of the nail T on which the drawing is performed (print finger Ua) is placed on a X-Y plane.

The upper side of the finger inserting unit 31 is divided by a ceiling unit 31*d*.

A window 31*e* is formed in the ceiling unit 31*d* to expose the nail T of the print finger Ua inserted in the finger inserting unit 31.

Moreover, a front wall 31*f* (see FIG. 1) is provided standing on both side portions of the front face side of the lower machine frame 11 on the upper face of the partition wall 116 to cover the front face side of the lower machine frame 11.

On the upper face of the partition wall 116, a pair of guide walls 31*g* is provided standing in a shape becoming narrow from the edge of the front wall 31*f* to the center portion side toward the finger inserting unit 31 to guide the print finger Ua in the finger inserting unit 31.

The user is able to place the partition wall 116 between the print finger Ua inserted in the finger inserting unit 31 and the non-print finger Ub inserted in the finger shelter unit 32. Therefore, the print finger Ua inserted in the finger inserting unit 31 is stably fixed.

According to the present embodiment, a projecting unit 116*b* projecting downward is formed in the front edge portion of the partition wall 116. The projecting unit 116*b* can be a tapered portion in which the thickness becomes gradually thinner toward the near side and gradually thicker toward the far side, or a configuration in which the thickness of the entire projecting unit 116*b* is thick compared to the caved in portion at the far side of the partition wall 116. Since the projecting unit 116*b* is formed in the front edge portion of the partition wall 116, there is a space between the nail T of the finger on which the drawing is already performed and the partition wall 116 when the non-print finger Ub is inserted in the finger shelter unit 32. Therefore, it is possible to prevent the nail T coming into contact with the bottom face of the partition wall 116 and the ink attaching to the apparatus or the design drawn on the nail T becoming damaged.

A drying apparatus 27 to dry the ink applied to the nail T is provided in the finger shelter unit 32. The drying apparatus 27 includes, for example a heater and a fan which are not shown.

According to the present embodiment, the drying apparatus 27 is attached to the wall on the far side of the finger shelter unit 32.

The configuration of the drying apparatus 27 and the position where the drying apparatus 27 is provided is not limited to the examples illustrated here. For example, the drying apparatus 27 can be composed of only a fan or only a heater.

Moreover, when the drawing is performed using photocurable ink (for example, UV curable ink), the drying apparatus 27 can be a light emitting apparatus which is able to emit light with a wavelength suitable for curing the ink.

A writing tool testing unit 61 is provided in a position on the upper face of the partition wall 116 and on the side of the finger inserting unit 31 (a position corresponding to the medium inserting opening 24 of the case main body 2 and according to the present embodiment, the left side of FIG. 1). The writing tool testing unit 61 is provided within the range where the later described drawing head 42 is able to draw, and the later described writing tool 41 is able to test write. Preferably, the writing tool testing unit 61 is provided to be substantially the same height as the nail T when the print finger Ua is inserted in the finger inserting unit 31.

The writing tool testing unit 61 has a flat plate shaped portion, and a drawing medium (not shown) inserted from the medium inserting opening 24 of the case main body 2 can be placed on this portion.

The drawing medium placed on the drawing tool testing unit 61 can be any medium with which a pen tip 412 can test write, and includes, for example, a piece of paper.

When the pen tip 412 is dry or the state of ink is not good, the start of drawing tends to be blurred. In order to prevent such situation, in the writing tool testing unit 61, the writing tool 41 is lowered on the drawing medium before starting drawing on the nail T according to the image data, and the writing tool 41 test writes by drawing a predetermined shape such as a circle or an infinity mark. With this, the pen tip 412 can be in a good state.

The predetermined shape which is drawn in the test writing is not limited. However, in order to prevent wasting ink, it is preferable that the shape is a simple shape such as a circle or an infinity mark.

It is preferable that the test writing of the circle, infinity mark, etc. is drawn shifting within the range of the writing tool testing unit 61 each time the shape is drawn.

When test writing is done on the entire drawing medium, the display unit 26 displays a display screen such as "please replace paper" in order to prompt the user to change the writing medium. In this case, the user takes out the drawing medium from the medium inserting opening 24 and replaces the drawing medium with a new drawing medium. With this, test writing can be done with the new drawing medium. If the drawing medium is a roll of paper, when there is no more space to draw, the drawing medium is rolled out and test writing can be done on the new face of the sheet.

For example, a rubber writing tool cap 62 is provided in the front of the writing tool testing unit 61 (near side in the finger inserting direction) according to the present embodiment. The writing tool cap 62 is provided in a number corresponding to the number of writing tools 41 attached to the drawing unit 40 (according to the present embodiment, 4). When the writing tool 41 is attached to the drawing unit 40 but the drawing is not performed (non-drawn state), the writing tool 41 is stored in the writing tool cap 62. The region where the writing tool cap 62, etc. is positioned is to be the home space where the writing tool 41 stands by when in a non-drawn state.

In other words, in a non-drawn state, after the writing tool 41 is moved directly above the writing tool cap 62, a later described solenoid 440 (see FIG. 4) lowers the writing tool 41, and stores the pen tip 412 in the writing tool cap 62. According to the above, it is possible to prevent the pen tip 412 from drying in a non-drawn state. The shape of the writing tool cap 62 is not limited to the illustrated examples. For example, the writing tool cap 62 can be a long groove shaped writing tool cap which can receive the pen tips 412 of all of the writing tools 41 attached to the drawing unit 40.

According to the present embodiment, the writing tool cap 62 is provided near the writing tool testing unit 61. Therefore, when the drawing is started, the writing tool 41 can be lifted and test writing can be done in the writing tool testing unit 61 which is right nearby, and the drawing can be started. Therefore, the time necessary to move the writing tool 41 can be made as short as possible, and prompt drawing operation is possible.

The drawing unit 40 draws on a nail based on the image data of the nail design using a plurality of types of ink. The drawing unit 40 includes a drawing head 42 including a writing tool 41, a unit supporting member 44 which supports the drawing head 42, a X-direction moving stage 45 to move the drawing head 42 in the X-direction (X-direction in FIG. 1, left and right direction of the nail print apparatus 1), a X-direction moving motor 46, a Y-direction moving stage 47 to move the drawing head 42 in the Y-direction (Y-direction in FIG. 2, front and back direction of nail print apparatus 1), a Y-direction moving motor 48, and the like.

According to the present embodiment, the drawing head 42 includes four writing tool carriages 43 which each hold one writing tool 41.

The writing tool 41 which is a drawing tool applies ink on the surface of the nail T to perform drawing.

Figure 4B:
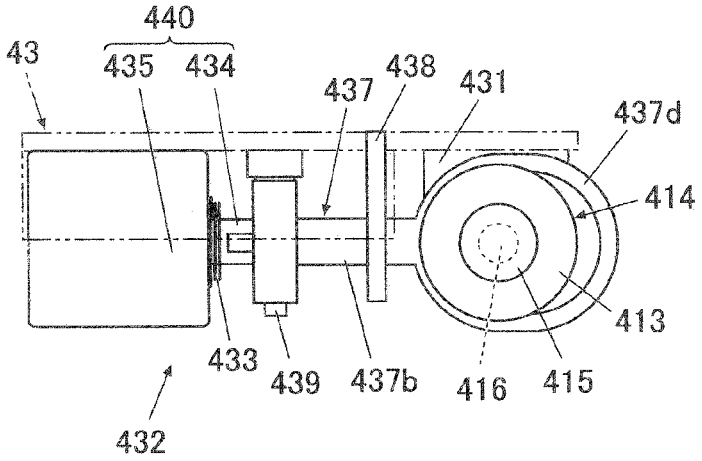
FIG. 4A, FIG. 4B, and FIG. 4C are enlarged views of a writing tool carriage in a drawing state and a writing tool supported by the carriage.
Figure 4A:
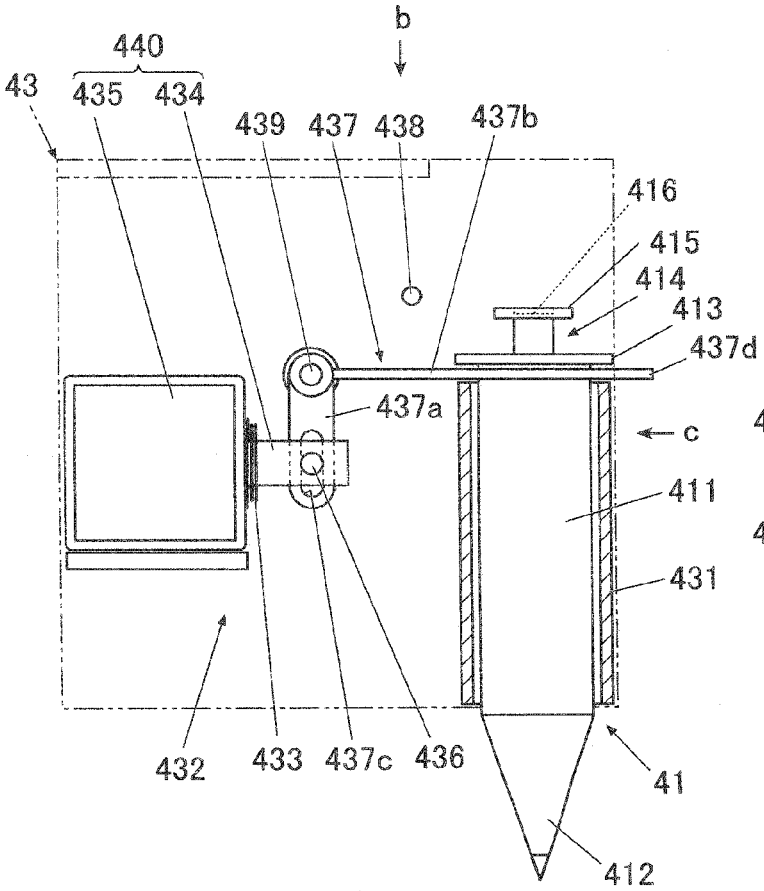
Figure 4C:
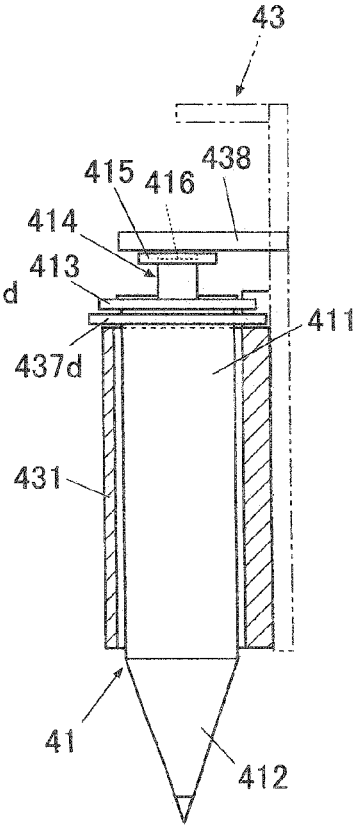

FIG. 4A to FIG. 4C are diagrams which enlarged the writing tool carriage 43 and the writing tool 41 supported by the writing tool carriage 43, and shows a state when drawing is performed (drawing state).

FIG. 4A is a side view of the writing tool carriage 43 and the writing tool 41. FIG. 4B is an upper view viewing the writing tool carriage 43 and the writing tool 41 shown in FIG. 4A from an arrow b direction. FIG. 4C is a front view viewing the writing tool carriage 43 and the writing tool 41 shown in FIG. 4A from an arrow c direction.

As shown in FIG. 4A to FIG. 4C, the writing tool 41 held by the writing tool carriage 43 is provided with the pen tip 412 at the tip of a pen axis portion 411. Inside the pen axis portion 411 is the ink storing unit which stores various ink. The ink stored inside the pen axis portion 411 is not limited regarding the viscosity, particle diameter of the coloring material (particle size) and the like. For example, ink including gold or silver glitter, white ink, UV curable ink, resin, manicure for under coat and top coat and the like can be used.

A lid portion 414 on which a brim portion 413 projecting outer than the pen axis portion 411 is formed is attached to the other end of the pen axis portion 411. The material to form the pen axis portion 411 and the lid portion 414 is not limited, and preferably a resin suitable for mass production of the writing tool 41 is used.

According to the present embodiment, a grip portion 415 is provided on the upper portion of the lid portion 414 to easily grip with a hand or tweezers. A small iron piece 416 is buried or attached to the grip portion 415 to be able to attract a magnet.

For example, the writing tool 41 is a pen to perform drawing by pressing the pen tip 412 to the surface of the nail T so that the ink stored in the pen axis portion 411 comes out. The pen tip 412 of the writing tool 41 is a ball point type. The drawing tool 41 is not limited to a ball point type pen, and can be, for example, a pen with a felt pen tip soaked with ink to perform drawing. Alternatively, a brush type pen with a bundle of hair soaked with ink to perform drawing can be used. The pen tip 412 with various thicknesses and shapes can be prepared.

The plurality of writing tools 41 held in each writing tool carriage 43 can be a pen with the same type of pen tip 412 or can be a writing tool with different pen tips 412.

As described later, the writing tool 41 is simply inserted from the above and held by a writing tool holding unit 437*b* and a writing tool holder 431 of the writing tool carriage 43. Therefore, the writing tool 41 can be easily replaced by opening the writing tool exchanging lid 23 provided in the case main body 2 and by gripping the grip portion 415 with the hand or tweezers or bringing a pole with a magnet at the tip (not shown) close to the grip portion 415 to attract the iron piece 416 to the magnet to be pulled up. Therefore, the user can realize various nail designs by suitably changing the writing tool 41 attached to each writing tool carriage 43 to the writing tool 41 with different types of pen tip 412 or different types of ink according to the desired nail design.

According to the present embodiment, four writing tool carriages 43 which hold the writing tool 41 are aligned in a width direction (left and right direction, X-direction in FIG. 1) of the apparatus. Therefore, the position of the pen tip 412 is shifted to the X-direction (left and right direction of the apparatus). The shift is an integral multiplication of one step in the drawing operation, and the drawing is performed correcting the number of steps in the amount of the shift according to the writing tool 41 which is used for drawing. The four drawing tools 41 can perform drawing in the same position.

Each writing tool carriage 43 is provided with a writing tool holder 431 which holds the writing tool 41 substantially vertically and a writing tool raising/lowering mechanism 432 to raise and lower the writing tool 41.

The writing tool holder 431 is a cylinder portion where the pen tip 412 and the pen axis portion 411 are inserted inside. With this, the writing tool holder 431 holds the writing tool 41.

The writing tool raising/lowering mechanism 432 includes a solenoid 440 including a plunger 434 and a coil unit 435, a pin 436 attached to the moving edge side of the plunger 434 of the solenoid 440, a writing tool raising/lowering lever 437 linked to the plunger 434 through the pin 436, and a stopper 438 which suppresses the writing tool raising/lowering lever 437 from rising too much.

The solenoid 440 has a mechanism in which the movable plunger 434 moves back and forth like a piston in the coil unit 435 wrapped with copper wire, etc. The plunger 434 is biased to the front (right side direction in FIG. 2 and FIG. 4A) by the spring 433, and the solenoid 440 is a pull type solenoid which pulls the plunger 434 toward the back (left side direction in FIG. 2 and FIG. 4A) against the bias force of the spring 433. The solenoid 440 is not limited to a pull type and may be a push type.

As shown in FIG. 4A, the writing tool raising/lowering lever 437 is a L-shaped member in which a short arm 437*a* and a long arm 437*b* intersect in a substantial right angle, and a long hole 437*c* which is latched to a pin 436 is formed at the tip side of the short arm 437*a*.

A writing tool holding unit 437*d* in which the writing tool 41 is inserted is provided on the tip side of the long arm 437*b*. The writing tool holding unit 437*d* is formed in a ring shape with an inner diameter larger than the diameter of the pen axis portion 411 and the pen tip 412 of the writing tool 41 and smaller than the diameter of the brim portion 413 of the pen axis portion 411. The pen axis portion 411 and the pen tip 412 are inserted in the writing tool holding unit 437*d*. The writing tool holding unit 437*d* hooks to the brim portion 413 to support the brim portion 413 from the lower side.

A rotating axis 439 is inserted through the crossing point between the short arm 437*a* and the long arm 437*b* in the writing tool raising/lowering lever 437 from the writing tool carriage 43 side.

According to the present embodiment, when the solenoid 440 is driven, as shown in FIG. 4A, the plunger 434 is pulled to the back against the bias force of the spring 433, and the writing tool raising/lowering lever 437 latched to the pin 436 of the plunger 434 is maintained in a position where the long arm 437*b* is substantially horizontal. In this state, the pen tip of the writing tool 41 is lowered to a state lower than the writing tool holder 431 of the writing tool carriage 43 and is in a drawing state which can come into contact with the surface of the nail T or the drawing medium.

When the solenoid 440 is free, the plunger 434 projects forward with the bias force of the spring 433. The writing tool raising/lowering lever 437 latched to the pin 436 of the plunger 434 rotates around the rotating axis 439 as the fulcrum in the upper direction (counter clockwise direction), and the long arm 437*b* comes into contact with the stopper 438 and stops. With this, the brim portion 413 of the writing tool 41 is thrown up by the writing tool raising/lowering lever 437 (see FIG. 2). In this state, the pen tip of the writing tool 41 is lifted higher than the writing tool holder 431 of the writing tool carriage 43 and is in a non-drawn state not in contact with the surface of the nail T or the drawing medium.

The force to move the plunger 434 of the solenoid 440 front and back is converted to the force to move the writing tool 41 up and down with the rotating axis 439 and the writing tool raising/lowering lever 437 rotating around the rotating axis 439 as the fulcrum.

The writing tool 41 is simply held inserted through the writing tool holder 431 of the writing tool carriage 43, and is not fixed to the writing tool raising/lowering lever 437, etc. Therefore, the writing tool 41 is biased toward the bottom by its own weight. With this, the writing tool 41 can lower itself freely along the writing tool holder 431 to the position where the brim portion comes into contact with the upper surface of the writing tool holding unit 437*d*. Moreover, when the writing tool 41 hits the surface of the nail T or the drawing medium, the pen tip 412 is pressed to the surface of the nail T and the drawing medium.

In other words, when drawing is performed with the drawing tool 41 on the nail T, the pen tip 412 is able to move freely in the Z direction (in other words, up and down direction) orthogonal to the XY plane where the print finger ha is placed, so as to follow (according to the curve and the height of the nail T) the shape of the surface of the nail T (up and down the surface).

For example, when drawing is performed in the portion where the height of the nail T is low (for example, both edge portions of the nail T in the width direction), the writing tool 41 is lowered to a position where the brim portion 413 comes into contact with the upper surface of the writing tool holding unit 437*d*. When drawing is performed in the portion where the height of the nail T is high (for example, center portion of the nail T in the width direction), the writing tool 41 is raised following the height of the nail T, and the brim portion 413 is separated from the upper surface of the writing tool holding unit 437*d*.

The weight of the writing tool 41 is a few grams to a few tens of grams and very light. Therefore, even if the pen tip 412 hits the nail T, the user does not feel pain. The pressure of the pen is maintained by the weight of the writing tool 41, and it is possible to draw a nail design on the nail T.

According to the present embodiment, among the members which compose the writing tool raising/lowering mechanism 432, the rotating axis 439 and the stopper 438 are formed from metal such as stainless steel. The other members are formed from material which are light and do not react to magnets, such as resin, etc. The material of the members which compose the writing tool raising/lowering mechanism 432 is not limited to the examples described above.

According to the present embodiment, a solenoid 440 is used as the actuator to raise and lower the writing tool 41. However, the actuator to raise and lower the writing tool 41 is not limited to the solenoid 440. Since the writing tool 41 is light in weight, other than the solenoid, other various small driving apparatuses can be used as the actuator to raise and lower the writing tool 41.

The unit supporting member 44 which supports the drawing head 42 is fixed to the X-direction moving unit 451 which is attached to the X-direction moving stage 45. The X-direction moving unit 451 moves in the X-direction along a guide not shown on the X-direction moving stage 45 driven by the X-direction moving motor 46. With this, the drawing head 42 moves in the X-direction (X-direction in FIG. 1, left and right direction of the nail print apparatus 1).

The X-direction moving stage 45 is fixed to the Y-direction moving unit 471 of the Y-direction moving stage 47. The Y-direction moving unit 471 moves along the guide (not shown) in the Y-direction on the Y-direction moving stage 47 driven by the Y-direction moving motor 48. With this, the drawing head 42 moves in the Y-direction (Y-direction in FIG. 2, front and back direction of nail print apparatus 1).

According to the present embodiment, the X-direction moving stage 45 and the Y-direction moving stage 47 are configured by combining the X-direction moving motor 46, the Y-direction moving motor 48, and ball screws and guides which are not shown. A step motor which moves a predetermined amount for each pulse that is transmitted is applied to the X-direction moving motor 46 and the Y-direction moving motor 48 of the present embodiment.

According to the present embodiment, the head driving unit 49 (see FIG. 5) is composed of the X-direction moving motor 46 and the Y-direction moving motor 48 to drive the drawing head 42 including the writing tool 41 to draw on the nail T in the X-direction and the Y-direction.

The solenoid 440 to move the writing tool 41 in the drawing unit 40 up and down, the X-direction moving motor 46, and the Y-direction moving motor 48 are connected to a later described drawing control unit 816 of a control apparatus 80 (see FIG. 5), and the above members are controlled by the drawing control unit 816.

As shown in FIG. 1 and FIG. 2, a capturing unit 50 is provided in the upper machine frame 12.

In other words, a substrate 13 is provided in the upper machine frame 12, and two cameras 51 as the imaging apparatus are provided in the lower face of the center portion of the substrate 13. Preferably, the camera 51 includes, for example, 2 million pixels or more.

The camera 51 captures the nail T of the print finger Ua inserted in the finger inserting unit 31, and obtains a nail image (finger image including image of nail T) which is an image of the nail T of the print finger Ua.

According to the present embodiment, the two cameras 51 are provided substantially aligned in the width direction of the nail T of the print finger Ua inserted in the finger inserting unit 31. Among the two cameras 51, one camera 51 is provided facing the base of the finger inserting unit 31 and captures the nail T from directly above.

The other camera 51 is positioned slightly tilted from the base of the finger inserting unit 31 and captures the nail T from diagonally above.

Illuminating lamps (illuminating apparatus) 52 such as white LED are positioned to surround the camera 51 on the substrate 13. The illuminating lamp 52 illuminates the nail T of the print finger Ua when the capturing is performed by the camera 51. The capturing unit 50 includes the camera 51 and the illuminating lamp 52.

The capturing unit 50 is connected to the later described capturing control unit 811 of the control apparatus 80 (see FIG. 5) and the capturing control unit 811 controls the capturing unit 50.

The image data of the image captured by the capturing unit 50 is stored in a later described nail image storage region 821 of the storage unit 82.

According to the present embodiment, the nail T can be captured from at least two different, positions and angles with the two cameras 51 as the imaging apparatus, and at least two nail images are obtained.

Based on the above nail images, a later described nail information detecting unit 812 is able to detect information regarding the nail such as the outline of the nail T (shape of the nail T), the tilting angle of the surface of the nail T with respect to the XY plane (hereinafter referred to as "tilting angle of nail T" or "nail curvature"), the vertical position of the nail T and the like. In other words, for example, by taking in the image of the nail T from directly above and the image of the nail T from diagonally above, it is possible to accurately detect not only the outline of the nail T but also the position and the tilting angle of the surface of the nail T.

The configuration including two cameras 51 as the imaging apparatus to be able to detect the tilting angle of the nail T or the nail curvature is not essential. Alternatively, the nail T can be captured from only the above and the outline of the nail T (shape of the nail T) can be detected as the nail information.

For example, the control apparatus 80 is positioned on the substrate 13 placed in the upper machine frame 12.

Figure 5:
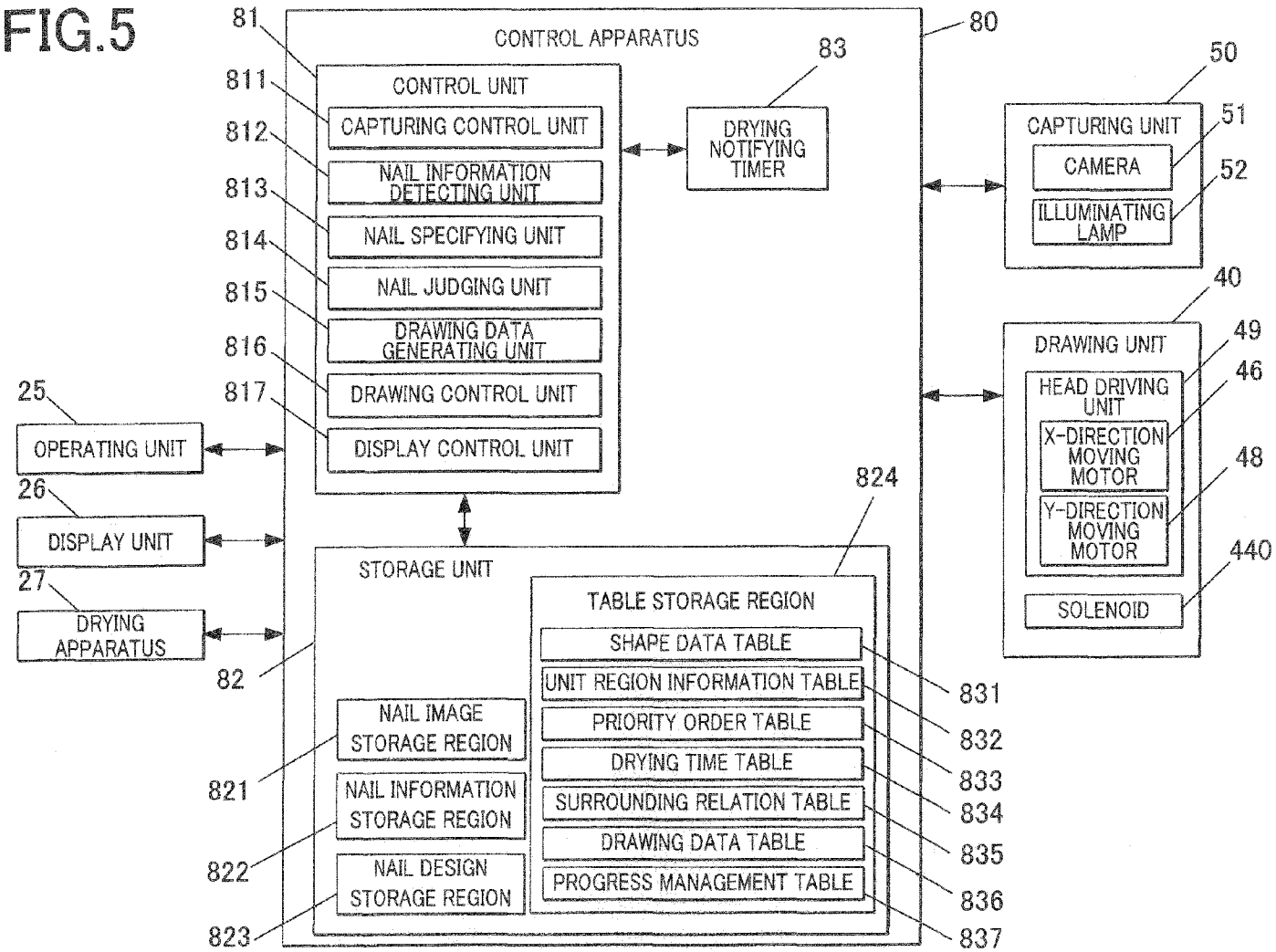
FIG. 5 is a main section block diagram showing a control configuration of a nail print apparatus of the present embodiment.

FIG. 5 is a main section block diagram showing a control configuration according to the present embodiment.

As shown in FIG. 5, the control apparatus 80 is a computer including a control unit 81 composed of the CPU (Central Processing Unit) and a storage unit 82 composed of a ROM (Read Only Memory) and a RAM (Random Access Memory) (all not shown).

Various programs to operate the nail print apparatus 1 and various pieces of data are stored in the storage unit 82.

Specifically, various programs are stored in the ROM of the storage unit 82, such as a nail information detecting program to detect nail information such as the shape of the nail T from the nail image, drawing data generating program to generate drawing data, drawing program to perform drawing processing and the like. Each unit of the nail print apparatus 1 is centrally controlled by the control apparatus 80 executing the above program.

The storage unit 82 of the present embodiment is provided with a nail image storage region 821 which stores the nail image of the nail T of the print finger Ua of the user obtained by the capturing unit 50, a nail information storage region 822 which stores nail information detected by the nail information detecting unit 812, a nail design storage region 823 which stores image data of a nail design drawn on the nail T, and a table storage region 824 which stores various data tables.

According to the present embodiment, the surface of the nail T of the print finger Ua is the drawing target region to be drawn by the drawing unit 40, and a plurality of unit regions ar are set in the drawing target region.

Here, each unit region ar is a connected region drawn with the same type of ink. Even if the regions are drawn with the same type of ink, if the regions are apart, the regions are set as different unit regions ar.

According to the present embodiment, when the user selects the nail design, the unit region ar to print the nail design is set for all of the nails T on which the nail design is to be drawn in a string of drawing processing and an area number (hereinafter referred to as "area No") is applied in advance to each unit region ar. The area No is applied as a consecutive number to all of the unit regions ar regardless of the type of nail T (type of finger).

Here, the string of drawing processing is a string of processing in which drawing is performed successively on all of the nails T set by the user in advance as the nails T on which drawing is performed. For example, when the user sets drawing on all of the nails T on the left hand and the right hand, drawing the nail design selected by the user on all nails T of the 10 fingers is the string of drawing processing.

According to the present embodiment, to simplify description, the example illustrated below is an example in which drawing is performed on nails T of 5 fingers (U1 to U5 shown in FIG. 6) of one hand using 2 types of ink.

Figure 6:
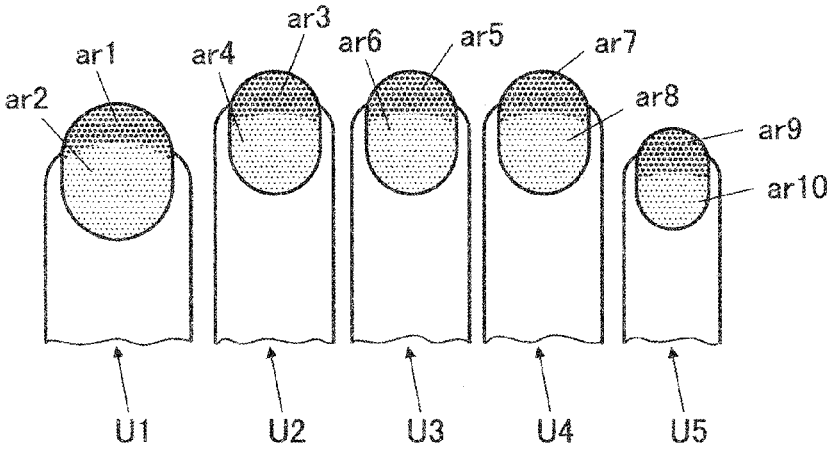
FIG. 6 is a diagram showing an example of a nail design which can be drawn by the nail print apparatus of the present embodiment.

In this case, as shown in FIG. 6, for example, 2 unit regions ar are set for each of the 5 nails T as the drawing target. Area No (ar1 to ar10 in FIG. 6) are applied as consecutive numbers to the 10 unit regions ar.

According to the present embodiment, the following tables are stored in the table storage region 824, a shape data table 831, a unit region information table 832, a priority order table 833, a drying time table 834, a surrounding relation table 835, a drawing data table 836, and a progress management table 837.

As described later, the shape of each nail T of each finger U1 to 05 is detected by the nail information detecting unit 812. The shape of the detected nail T is stored in the nail information storage region 822 as shape data composed of, for example, x-coordinate and y-coordinate information and in the shape data table 831 of the table storage region 824.

Table 1 is one example of the shape data table 831 when the nail design shown in FIG. 6 is drawn.

TABLE 1

| FINGER No | SHAPE DATA |
|---|---|
| U1 | SHAPE 1 |
| U2 | SHAPE 2 |
| U3 | SHAPE 3 |
| U4 | SHAPE 4 |
| U5 | SHAPE 5 |

As shown in Table 1, shape 1 to shape 5 of the nail T of each finger U1 to U5 are registered associated with the finger No (in other words, U1 to U5) of each print finger Ua in the shape data table 831. In the shape data table 831, the shape data itself can be stored or identification information to link with the shape data of each nail T stored in the nail information storage region 822 can be stored.

Table 2 shows one example of the unit region information table 832.

TABLE 2

| FINGER No | AREA No | AREA No |
|---|---|---|
| U1 | 1 | 2 |
| U2 | 3 | 4 |
| U3 | 5 | 6 |
| U4 | 7 | 8 |
| U5 | 9 | 10 |

As shown in Table 2, the unit region information table 832 associates the finger No of each print finger Ua (in other words, U1 to U5) with the area No (ar1 to ar10 in Table 2) of the unit region ar set in each print finger Ua.

The unit region information table 832 manages where each of the plurality of unit regions an is in each nail T. The table storage region 824 which stores the unit region information table 832 functions as the unit region information storage unit.

When the later-described drawing control unit 816 performs the drawing control processing, the drawing control unit 816 checks whether drawing is possible on each unit region ar in order starting from those with the high priority order set in advance.

Table 3 shows one example of a priority order table 833.

TABLE 3

| AREA No | PRIORITY ORDER |
|---|---|
| 1 | 1 |
| 2 | 6 |
| 3 | 2 |
| 4 | 7 |
| 5 | 3 |
| 6 | 8 |
| 7 | 4 |
| 8 | 9 |
| 9 | 5 |
| 10 | 10 |

The priority order table 833 associates the area No of the unit region ar (ar1 to ar10 in Table 3) with the priority order of each unit region ar. The priority order table 833 is set so that unit regions an in contact with each other are not in continuing orders.

For example, according to the present embodiment, as shown in Table 3, the order of the unit region ar set in the same nail T of the print finger Ua (for example, unit regions an and ar2 set on the nail T of the finger U1) is set so as not to continue. The unit regions ar of the nail tip portion of the fingers U1 to U5 (in other words, ar1, ar3, ar5, ar7, and ar9 in FIG. 6) are set with the priority order first to fifth in order from the small finger No (in other words, in the order of finger No U1 to U5 in FIG. 6). The unit regions ar of the nail root portion of the fingers U1 to U5 (in other words, ar2, ar4, ar6, ar8, and ar10 in FIG. 6) are set with the priority order sixth to tenth in order from the small finger No (in other words, in order of finger No U1 to U5 in FIG. 6). The method of applying the priority order is not limited to the method illustrated here and can be suitably set considering the area of each unit region ar and the type of ink to be applied.

Table 4 shows an example of the drying time table 834.

TABLE 4

| AREA No | SET VALUE OF DRYING TIME [sec] |
|---|---|
| 1 | 20 |
| 2 | 30 |
| 3 | 20 |
| 4 | 30 |
| 5 | 20 |
| 6 | 30 |
| 7 | 20 |
| 8 | 30 |
| 9 | 20 |
| 10 | 30 |

As shown in Table 4, the drying time table 834 associates the unit region ar with the drying time which is set a time required for completion of drying of the ink applied to each unit region ar. The drying time for each region in each nail design is included in the information of the image data of each nail design, and the drying time in the drying time table 834 is set based on the information included in the image data.

For example, according to Table 4, the drying time of the unit region ar of area No 1 (unit region ar1 in FIG. 6) is set to 20 seconds, and the drying time of the unit region ar of area No 2 (unit region ar2 in FIG. 6) is set to 30 seconds.

The ease of drying changes depending on the composition and the viscosity of the ink. Therefore, the drying time for each unit region ar is set considering the difference of the ease of drying according to type of ink (color) applied to the unit region ar.

Table 5 shows an example of the surrounding relation table 835.

TABLE 5

| AREA No | SET VALUE OF ADJACENT REGION |
|---|---|
| 1 | 2 |
| 2 | 1 |
| 3 | 4 |
| 4 | 3 |
| 5 | 6 |
| 6 | 5 |
| 7 | 8 |
| 8 | 7 |
| 9 | 10 |
| 10 | 9 |

As shown in Table 5, the surrounding relation table 835 associates the area No of each unit region ar with the area No of the unit region ar in contact with each unit region ar (hereinafter referred to as "adjacent region") based on the image data.

According to the present embodiment, the unit regions ar set in the nail T of the same print finger Ua are the adjacent regions (for example, the unit regions ar1 and ar2 set in the nail T of the finger U1). Therefore, for example, according to Table 5, the unit region ar of area No 2 is associated with the unit region ar of area No 1 as the adjacent region and the unit region ar of area No 1 is associated with the unit region ar of area No 2 as the adjacent region.

Table 6 shows an example of the drawing data table 836.

TABLE 6

| AREA No | DRAWING DATA |
|---|---|
| 1 | DRAWING DATA 1 |
| 2 | DRAWING DATA 2 |
| 3 | DRAWING DATA 1 |
| 4 | DRAWING DATA 2 |
| 5 | DRAWING DATA 1 |
| 6 | DRAWING DATA 2 |
| 7 | DRAWING DATA 1 |
| 8 | DRAWING DATA 2 |
| 9 | DRAWING DATA 1 |
| 10 | DRAWING DATA 2 |

As shown in Table 6, the drawing data table 836 associates the area No of each unit region ar with the drawing data of the image drawn in each unit region ar of each area No.

The example described here shows the area No of each unit region ar stored in the storage region different from the image data itself of the image drawn in each unit region ar (according to the present embodiment, image data of the nail design stored in the nail design storage region 823). Alternatively, the area No can be positioned at the top, bottom or the like of each piece of the image data of the unit region ar.

Tables 7 to 11 show examples of the progress management table 837.

TABLE 7

| AREA No | DRAWING STATUS | DRYING TIME [sec] |
|---|---|---|
| 1 | 0 | 0 |
| 2 | 0 | 0 |
| 3 | 0 | 0 |
| 4 | 0 | 0 |
| 5 | 0 | 0 |
| 6 | 0 | 0 |
| 7 | 0 | 0 |
| 8 | 0 | 0 |
| 9 | 0 | 0 |
| 10 | 0 | 0 |

TABLE 8

| AREA No | DRAWING STATUS | DRYING TIME [sec] |
|---|---|---|
| 1 | 1 | 0 |
| 2 | 0 | 0 |
| 3 | 0 | 0 |
| 4 | 0 | 0 |
| 5 | 0 | 0 |
| 6 | 0 | 0 |
| 7 | 0 | 0 |
| 8 | 0 | 0 |
| 9 | 0 | 0 |
| 10 | 0 | 0 |

TABLE 9

| AREA No | DRAWING STATUS | DRYING TIME [sec] |
|---|---|---|
| 1 | 9 | 20 |
| 2 | 0 | 0 |
| 3 | 1 | 0 |
| 4 | 0 | 0 |
| 5 | 0 | 0 |
| 6 | 0 | 0 |
| 7 | 0 | 0 |
| 8 | 0 | 0 |

TABLE 9-continued

| AREA No | DRAWING STATUS | DRYING TIME [sec] |
|---|---|---|
| 9 | 0 | 0 |
| 10 | 0 | 0 |

TABLE 10

| AREA No | DRAWING STATUS | DRYING TIME [sec] |
|---|---|---|
| 1 | 9 | 0 |
| 2 | 1 | 0 |
| 3 | 9 | 5 |
| 4 | 0 | 0 |
| 5 | 9 | 10 |
| 6 | 0 | 0 |
| 7 | 9 | 15 |
| 8 | 0 | 0 |
| 9 | 9 | 20 |
| 10 | 0 | 0 |

TABLE 11

| AREA No | DRAWING STATUS | DRYING TIME [sec] |
|---|---|---|
| 1 | 9 | 0 |
| 2 | 9 | 30 |
| 3 | 9 | 3 |
| 4 | 1 | 0 |
| 5 | 9 | 8 |
| 6 | 0 | 0 |
| 7 | 9 | 13 |
| 8 | 0 | 0 |
| 9 | 9 | 18 |
| 10 | 0 | 0 |

As shown in Tables 7 to 11, the progress management table 837 associates the drawing status and the drying time with the unit region ar of each area No.

Here, the drawing status is any one of non-drawn state, drawing in progress, or drawing complete. According to Tables 7 to 11, "0" is set to the unit region ar in a non-drawn state, "1" is set to the unit region ar in which drawing is in progress, and "9" is set to the unit region ar in which drawing is complete.

The progress management table 837 is suitably updated according to the progress status of the drawing processing.

For example, before drawing starts, as shown in Table 7, the drawing status in all unit regions ar is "0" showing the non-drawn state, and the drying time is also set to "0". When the drawing starts in the unit region ar of area No 1 which is first in the priority order, as shown in Table 8, the drawing status of area No 1 is set to "1" showing drawing is in progress. When the drawing in the unit region ar of area No 1 ends and the drawing in the unit region ar of area No 3 next in the priority order starts, as shown in Table 9, the drawing status of area No 1 is set to "9" showing drawing is complete, and the drawing status of area No 3 is set to "1" showing drawing is in progress.

The drying time of the area No 1 in which drawing is complete is set to 20 seconds. As shown in Tables 10 and 11, the drying time reduces as time passes reflecting the result of time kept by a later described drying notifying timer 83.

Functionally, the control unit 81 includes, a capturing control unit 811, a nail information detecting unit 812, a nail specifying unit 813, a nail judging unit 814, a drawing data generating unit 815, a drawing control unit 816, a display control unit 817, and the like. Such functions as the capturing control unit 811, the nail information detecting unit 812, the nail specifying unit 813, the nail judging unit 814, the drawing data generating unit 815, the drawing control unit 816, the display control unit 817, and the like are realized by the CPU of the control unit 81 in coordination with the program stored in the ROM of the storage unit 82.

According to the present embodiment, the drying notifying timer 83 is connected to the control unit 81.

When drying starts in the unit region ar, the value of the drying time associated with the area No corresponding to the unit region ar is set in the drying notifying timer 83 based on the drying time table 834 as shown in Table 4 (drying time required for completion of drying of the ink as defined in the drying time table 834 of Table 4) and counting of the elapsed time starts.

According to the present embodiment, the point of time when the drawing of one unit region ar ends and the print finger Ua where the unit region ar on which drawing is performed next belongs is inserted in the finger inserting unit 31 is when the drying notifying timer 83 starts counting as the point of time when the drying of the unit region ar on which drawing is performed starts. The point of time when the drying starts is not limited to this point. Alternatively, for example, a sensor or a camera can be provided in the finger shelter unit 32 to detect the point of time when the finger of the nail T on which drawing is performed is inserted in the finger shelter unit 32, and this can be the point of time when the drying starts.

When the counted elapsed time reaches the drying time required for completion of drying of the ink of the unit region ar, the drying notifying timer 83 outputs a drying time end signal to the control unit 81, and notifies the above to the control unit 81.

For example, when the drawing of the unit region ar1 ends and the finger U2 where the unit region ar3 on which the next drawing is performed belongs is inserted in the finger inserting unit 31, at this point of time, the drying time "20 seconds" necessary to dry the ink of the unit region ar1 is set in the drying notifying timer 83, and the drying notifying timer 83 starts counting the elapsed time from when the drying starts. After 20 seconds pass, the drying time end signal is output from the drying notifying timer 83 to the control unit 81, and the control unit 81 is notified that the predetermined drying time of "20 seconds" has passed.

When the control unit 81 is notified that the predetermined drying time has passed from the drying notifying timer 83, the drying time of the unit region ar is set to "0" in the progress management table 837.

The control unit 81 can suitably obtain the elapsed time counted by the drying notifying timer 83 and update the item of the drying time of each unit region ar in the progress management table 837.

The capturing control unit 811 controls the camera 51 and the illuminating lamp 52 of the capturing unit 50 to capture the image of the finger including the image (hereinafter referred to as "nail image") of the nail T of the print finger Ua inserted in the finger inserting unit 31 with the camera 51.

According to the present embodiment, the capturing control unit 811 obtains at least 2 nail images from different positions and angles (for example, above the nail T and diagonally above the nail T) with the 2 cameras 51.

The image data of the nail image obtained by the capturing unit 50 can be stored in the storage unit 82.

The nail information detecting unit 812 detects the nail information of the nail T of the print finger Ua based on the image of the nail T of the print finger Ua inserted in the finger inserting unit 31 captured by the camera 51.

For example, here, the nail information includes, the outline of the nail T (nail shape, horizontal position of the nail T), the tilting angle of the surface of the nail T with respect to the XY plane (tilting angle of the nail T, nail curvature), and the height of the nail T (position of the nail T in the vertical direction, hereinafter referred to as "vertical position of nail T", or simply "position of nail T"). The tilting angle of the nail T (nail curvature) is the angle with respect to the horizontal plane in the width direction of the nail T (for example, the XY plane of the finger placing unit 116*a* where the print finger Ua is placed).

Specifically, the nail information detecting unit 812 detects the outline of the nail T (shape and size) and position from the nail image of the nail T of the print finger Ua obtained by the camera 51. The outline is obtained as information represented by x and y coordinates. For example, the nail information detecting unit 812 detects the outline (shape) of the nail T based on the difference in color between the nail T and other portions of the finger from the nail image of the nail T of the print finger Ua obtained by the camera 51. The method of how the nail information detecting unit 812 detects the outline (shape) of the nail T is not limited to the method as described above, and is not limited to methods illustrated here.

The nail information detecting unit 812 functions as the tilting angle detecting unit which detects the tilting angle (nail curvature) of the nail T based on the at least 2 nail images captured by the 2 cameras 51.

For example, the nail information detecting unit 812 detects the tilting angle (nail curvature) of the nail T of the user from the 2 nail images captured from different positions and angles (for example, above the nail T and diagonally above the nail T) by the 2 cameras 51. The method of how the nail information detecting unit 812 detects the tilting angle (nail curvature) of the nail T is not limited to the above, and is not limited to methods illustrated here.

The nail information detecting unit 812 is to at least detect the outline of the nail T (nail shape) based on the nail image, and does not have to obtain all of the above pieces of nail information.

The nail specifying unit 813 specifies the nail T (specific nail which is a print finger Ua including the nail T) including a non-drawn unit region ar (hereinafter referred to as "specific unit region") with all of the adjacent regions ar being at least either the dried unit region ar in which the ink is applied and the drying of the ink is completed or the non-drawn unit region ar in which the ink is not yet applied as the nail T (specific nail which is a print finger Ua including the nail T) to be positioned in the finger inserting unit 31 which is the drawing position. In other words, specific unit region is one of the non-drawn unit regions which are not in contact with a non-dried unit region ar in which the ink is applied and the drying of the ink is not completed.

According to the present embodiment, the nail specifying unit 813 determines the unit region ar on which drawing is performed next according to the priority order based on the priority order table 833 and judges whether drawing can be performed in the unit region ar.

The nail specifying unit 813 refers to the progress management table 837 to judge whether drawing is possible. The nail specifying unit 813 judges that the drawing on the unit region ar is possible when the drawing status of the unit region ar in the progress management table 837 is "0" (in other words, non-drawn state) and the drawing status of the unit region ar which is the adjacent region of the above unit region ar in the surrounding relation table 835 is "0" (in other words, non-drawn state) or "9" (in other words, drawing is complete) and the drying time is "0".

When the drawing is possible, the nail specifying unit 813 specifies the finger No corresponding to the nail T where the unit region ar belongs based on the unit region information table 832.

When the finger No of the nail T where the specific unit region belongs is specified, an instruction to urge the user to insert the print finger Ua of the finger No (for example, if the print finger Ua is finger No3 shown in FIG. 6, the middle finger) in the finger inserting unit 31 is displayed on the display unit 26. Specifically, the nail specifying unit 813 displays an instruction to the user on the display unit 26 with the display control unit 817.

When the user positions the print finger Ua in the finger inserting unit 31 which is the drawing position, the nail judging unit 814 judges whether the nail T specified by the nail specifying unit 813 is positioned in the finger inserting unit 31.

Specifically, when the print finger Ua is positioned in the finger inserting unit 31, the capturing unit 50 captures the nail image and the shape of the nail T is detected by the nail information detecting unit 812 based on the nail image. The nail judging unit 814 judges whether the inserted nail T is the nail T of the print finger Ua of the finger No specified by the nail specifying unit 813 based on the shape of the nail T detected by the nail information detecting unit 812 and the nail shape of each finger U1 to U5 registered in advance in the shape data table 831.

According to the present embodiment, when the nail judging unit 814 judges that the nail T positioned in the finger inserting unit 31 is not the nail T of the print finger Ua of the finger No specified by the nail specifying unit 813, the above is displayed on the display unit 26 and an instruction screen to urge the user to position the correct nail T is displayed on the display unit 26.

The drawing data generating unit 815 generates drawing data to draw on the nail T of the print finger Ua with the drawing head 42 based on the nail information such as the nail shape detected by the nail information detecting unit 812.

Specifically, the drawing data generating unit 815 performs matching processing by enlarging, reducing, cutting, etc. the image data of the nail design based on the shape of the nail T detected by the nail information detecting unit 812, and generates the data for drawing on the nail T. When the nail information detecting unit 812 obtains the tilting angle (nail curvature) of the nail T as the nail information, the drawing data generating unit 815 corrects the curved surface of the image data of the nail design according to the tilting angle (nail curvature) of the nail T.

When there is a unit region ar already drawn on the nail T (drawn region), the drawing data generating unit 815 generates the drawing data based on the nail shape of the nail T and the shape of the drawn unit region ar. In this case, fitting processing is performed according to the image data of the nail design. For example, when the image data shows that the region needs to be in contact with the drawn region, the regions are in contact without space in between. When the image data shows that a space is necessary between the region and the drawn region, a space is made in between.

The drawing control unit 816 is a control unit which outputs drawing data generated by the drawing data generating unit 815 to the drawing unit 40, and controls the solenoid 440 of the drawing unit 40, the X-direction moving motor 46, and the Y-direction moving motor 48 to draw according to the drawing data on the nail T.

According to the present embodiment, the drawing control unit 816 controls the drawing operation of the drawing unit 40 to draw each unit region ar.

Specifically, the drawing control unit 816 controls the drawing operation of the drawing unit 40 to draw on the specific unit region of the nail T specified by the nail specifying unit 813 (non-drawn unit region ar with all of the adjacent unit regions ar being at least either the dried unit region ar in which the ink is applied and the drying of the ink is completed, or the non-drawn unit region ar in which the ink is not applied).

The display control unit 817 controls the display unit 26 and displays various display screens on the display unit 26. According to the present embodiment, the display control unit 817 displays various screens on the display unit 26 such as the selection screen of the nail design, the thumbnail image for confirming the design, the nail image capturing the print finger Ua including the nail T and the like.

When the nail T belonging to the unit region ar on which the image is to be drawn is specified by the nail specifying unit 813, the instruction screen instructing the user to insert the print finger Ua corresponding to the nail T in the finger inserting unit 31 is displayed on the display unit 26.

Figure 7:
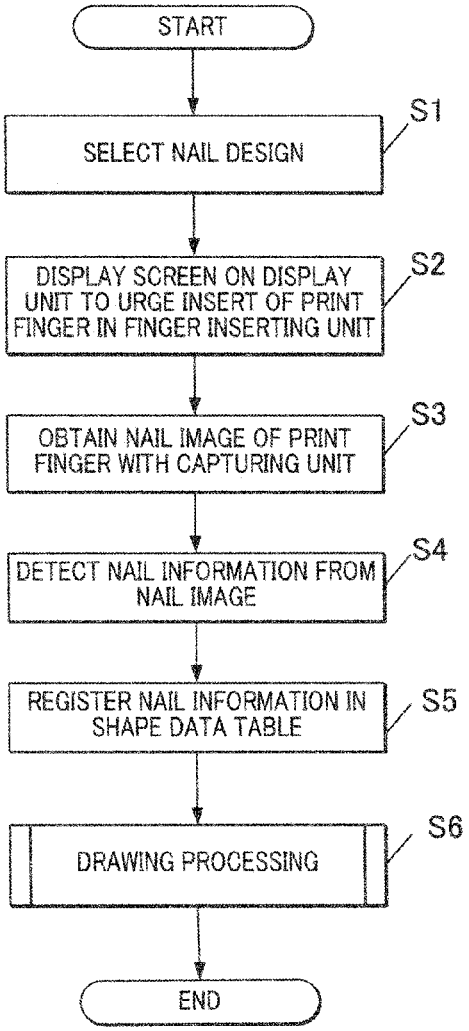
FIG. 7 is a flowchart showing an entire flow of processing performed in the nail print apparatus of the present embodiment.
Figure 8:
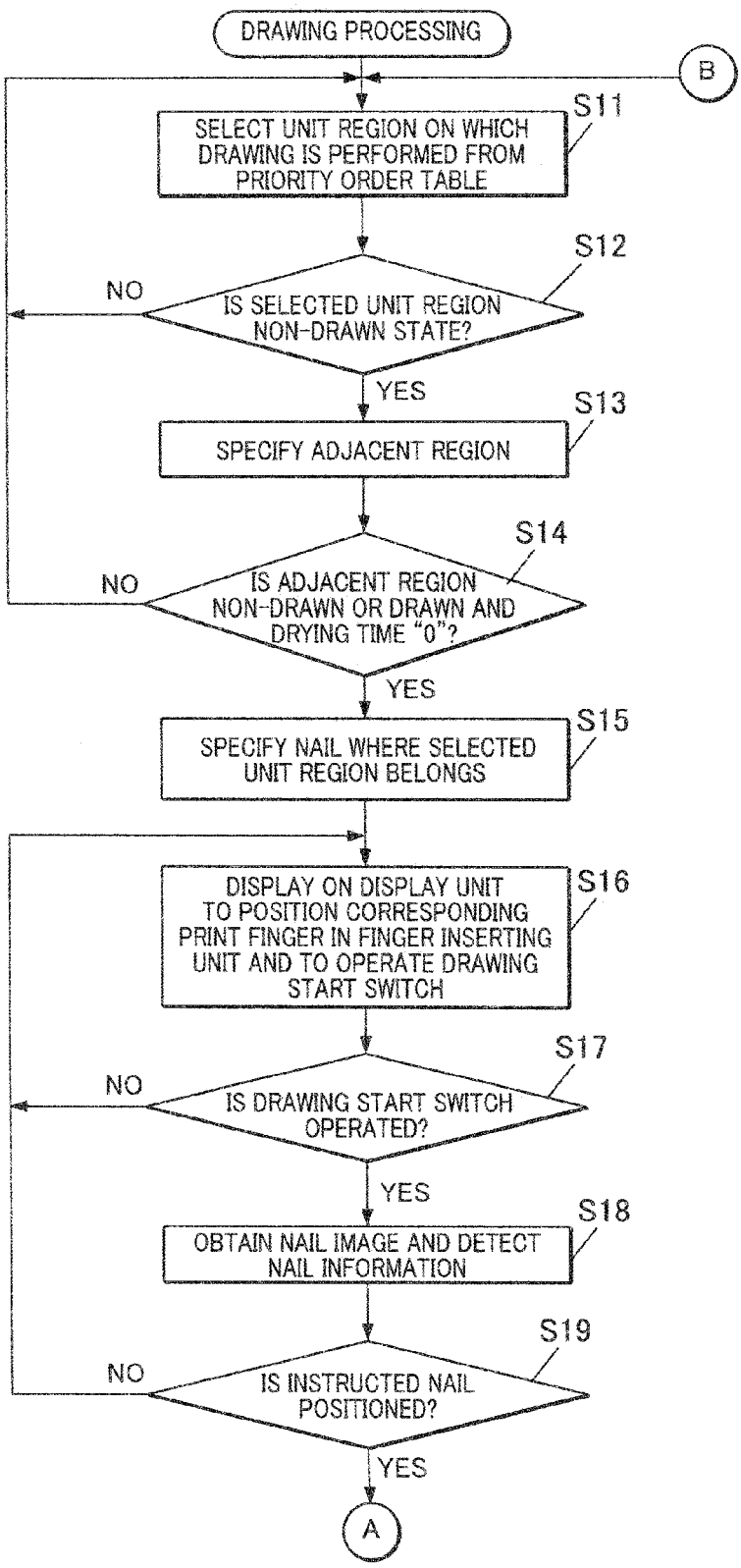
FIG. 8 is a flowchart showing drawing processing of a nail print apparatus of the present embodiment.
Figure 9:
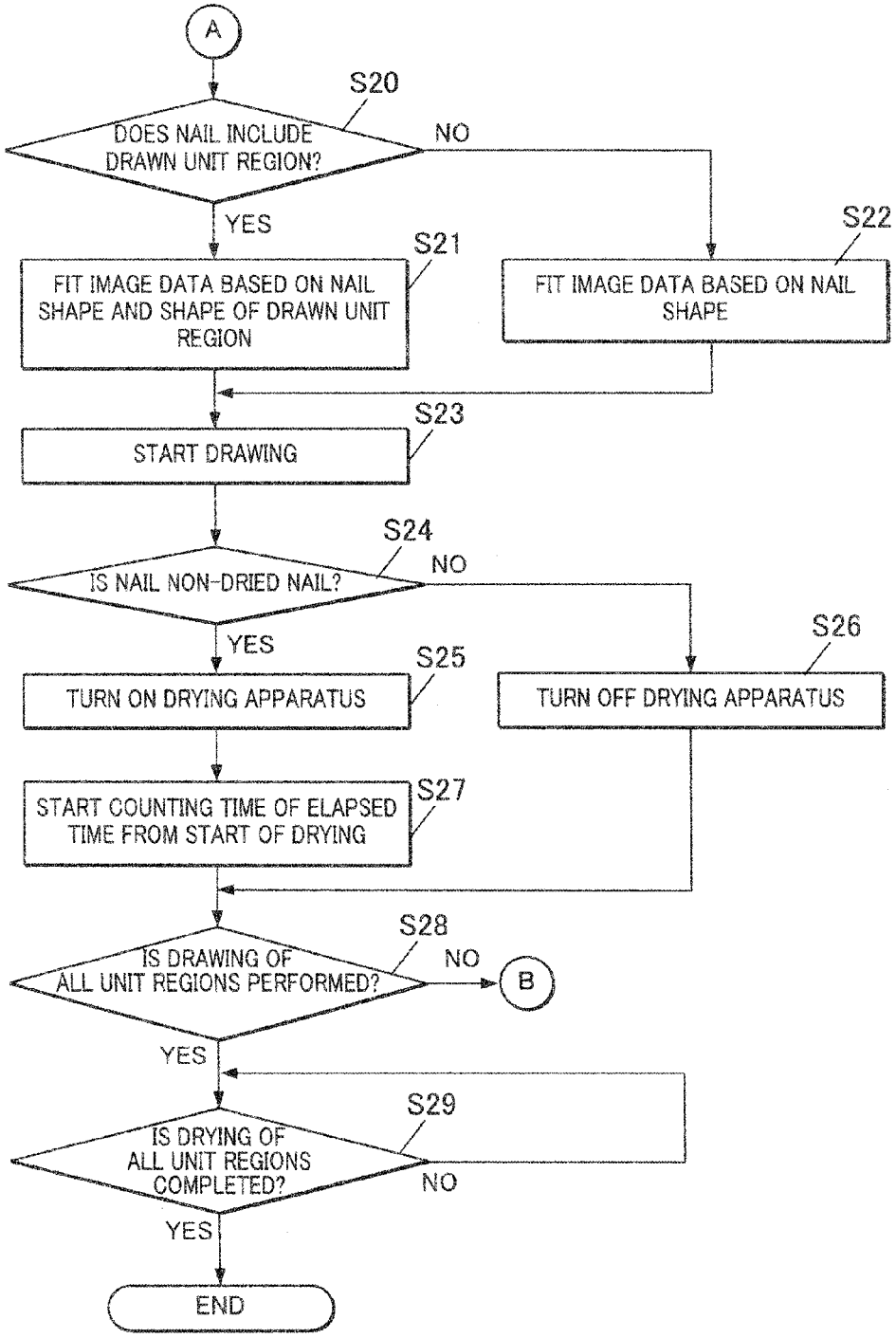
FIG. 9 is a flowchart showing drawing processing of a nail print apparatus of the present embodiment.

Next, with reference to FIG. 7 to FIG. 9, the operation of the nail print apparatus 1 and the method of printing according to the present embodiment are described.

When drawing is performed with the nail print apparatus 1, first, the user turns on the power switch and starts the control apparatus 80.

The display control unit 817 displays the design selection screen on the display unit 26. The user operates the operating button 251, etc. of the operating unit 25 to select the desired nail design from the plurality of nail designs displayed on the design selecting screen. With this, the selecting instruction signal is output from the operating unit 25, and as shown in FIG. 7, the nail design to be drawn on the nail T is selected (step S1).

When the nail design is selected, the control unit 81 displays an instruction screen on the display unit 26 to urge the user to successively insert in the finger inserting unit 31 all of the print fingers Ua which the user desires drawing (step 92). Preferably, for example, the type of print finger Ua to be inserted is instructed, such as "please first insert thumb" or the order of the print finger Ua to be inserted is instructed on the instruction screen, such as "please insert fingers in the following order, thumb, index finger, middle finger, ring finger, and little finger".

When the user inserts the print finger Ua in the finger inserting unit 31 according to the instruction, the capturing control unit 811 controls the capturing unit 50, and the print finger Ua is captured by the camera 51 while the print finger Ua is illuminated by the illuminating lamp 52. With this, the image of the nail T (nail image) of the print finger Ua inserted in the finger inserting unit 31 is obtained by the capturing unit 50 (step S3).

Next, the nail information detecting unit 812 detects the nail information of the outline (nail shape), etc. of the nail T of each print finger Ua based on the nail image of each print finger Ua obtained by the capturing unit 50 (step S4).

The nail information detected by the nail information detecting unit 812 is stored in the nail information storage region 822 and registered in the shape data table 831 corresponded with the finger No determined by the inserting order, etc. of the print finger Ua (step S5).

When the nail information is obtained for all of the print fingers Ua on which the image is drawn, the drawing processing is performed (step S6).

As shown in FIG. 8, according to the drawing processing of the present embodiment, the nail specifying unit 813 judges the unit region ar on which drawing is performed first, and specifies the finger No of the print finger Ua corresponding to the unit region ar.

Specifically, the nail specifying unit 813 obtains the unit region on which drawing is performed from the priority order table 833 (step S11).

When the unit region ar is selected according to the priority order table 833, the nail specifying unit 813 judges whether the unit region ar is a non-drawn state by referring to the progress management table 837 (step S12). When drawing is already performed on the selected unit region ar (step S12; NO), the processing returns to step S11 and the unit region ar in the next priority order is selected from the priority order table 833.

When drawing is not yet performed on the selected unit region ar (step S12; YES), the nail specifying unit 813 refers to the surrounding relation table and specifies the adjacent region adjacent to the unit region ar (step S13). When the adjacent region is specified, the progress management table 837 is referred, and it is judged whether drawing is not yet performed on the adjacent region or drawing is already performed and the drying time is "0" and drying is completed (step S14). When it is judged that drawing is performed on the adjacent region but the drying time is not "0" (step S14; NO), the processing returns to step S11, and the unit region ar next in the priority order is selected from the priority order table 833.

When it is determined that the drawing is not yet performed on the adjacent region or the drawing is already performed and the drying time is "0" (step S14; YES), the nail specifying unit 813 refers to the unit region information table 832 and specifies the nail T where the selected unit region ar belongs (step S15). Then, an instruction is displayed on the display unit 26 to position the print finger Ua where the nail T belongs in the finger inserting unit 31 and to operate the drawing start switch (step S16).

The user positions the print finger Ua specified by the instruction in the finger inserting unit 31, the other fingers are evacuated to the finger shelter unit 32, and the drawing start switch (not shown) of the operating unit 25 is operated.

The control unit 81 judges whether the drawing start switch is operated (step S17). When the drawing start switch is operated (step S17; YES), the nail T set in the finger inserting unit 31 is captured, and the nail shape, etc. is detected based on the captured nail image (step S18). The nail judging unit 814 compares the detected nail shape with the shape data table 831 and judges whether the correct nail T according to the instruction is positioned in the finger inserting unit 31 (step S19).

When the drawing start switch is not operated (step S17; NO), or the nail T positioned in the finger inserting unit 31 is not the instructed nail T (step S19; NO), the processing returns to step S16 and the instruction to place the instructed nail T in the finger inserting unit 31 and operate the drawing start switch is repeated.

When the nail judging unit 814 judges that the nail T positioned in the finger inserting unit 31 is the instructed nail T (step S19; YES), the following drawing process is started.

Even if the drawing start switch is not operated, when the nail T set in the finger inserting unit 31 is acknowledged and it is judged that the correct nail T according to the instruction is set compared to the shape data table 831, if the nail T is still for about 1 second after the nail T is placed, the setting of the nail T can be considered to be finished and the same operation as operating the drawing start switch can be performed.

As shown in FIG. 9, when the instructed nail T is positioned, the control unit 81 judges whether the drawn unit region ar is included in the nail T (step S20). When the drawn unit region ar is included (step S20; YES), the drawing data generating unit 815 fits the image data of the nail design based on the nail shape and the shape of the drawn unit region ar and generates the drawing data (step S21).

When the drawn unit region ar is not included (step S20; NO), the drawing data generating unit 815 fits the image data of the nail design based on the nail shape of the nail T and generates the drawing data (step S22). Here, the state of fitting can be displayed on the display unit 26 and confirmed by the user.

When the drawing data generating unit 815 generates the drawing data, the drawing control unit 816 outputs the drawing data to the drawing unit 40, drives the solenoid 440 of the writing tool carriage 43 holding the writing tool 41 necessary for drawing so that the drawing tool 41 is able to draw, and the drawing head 42 is suitably moved in the XY direction based on the drawing data to draw the nail design on the nail T (step S23). Here, the writing tool 41 is pressed on the surface of the nail T by its own weight and drawing is performed by moving up and down following the shape of the surface of the nail T.

When the drawing starts, the control unit 81 refers to the progress management table 837 and judges whether the nail T is not dry (in other words, whether the drying time of the nail T is not yet "0") (step S24). When the nail T is not dry (step S24; YES), the drying apparatus 27 (for example, fan) is turned ON (step S25). When the drawing is performed successively, the drying apparatus 27 may already be turned ON, and in this case the ON state is maintained. When the nail T is not a not dry nail (step S24; NO), the drying apparatus 27 (for example, fan) is turned OFF (step S26). After the drying apparatus 27 is turned on at the start of the string of drawing processing, the drying apparatus 27 can be maintained in the ON state until the drawing and drying of all nails T end.

The control unit 81 turns on the drying notifying timer 83 and starts counting the elapsed time from the start of drying of the unit region ar on which drawing was performed just before (step S27). The result of time counted by the drying notifying timer 83 is reflected on the progress management table 837. In other words, according to the present embodiment, when the drawing of the unit region ar is performed and the nail T where the unit region ar on which the next drawing is performed belongs is placed in the finger inserting unit 31, the drawing status of the unit region ar on which drawing was performed just before is set to drawing complete, "9", in the progress management table 837, and the drying time required for completion of drying of the ink of the unit region ar is set to the drying time in the progress management table 837. The value of the drying time is reduced to "0" according to the result of time counted by the drying notifying timer 83.

The control unit 81 refers to the progress management table 837 and judges whether the drawing of all unit regions ar is performed (step S28). When it is not performed (step S28; NO), the processing returns to step S11, the next unit region ar on which drawing is performed is selected, and the processing is repeated.

When the drawing of all unit regions ar ends (step S28; YES), the control unit 81 refers to the progress management table 837 and judges whether the drying of all unit regions ar is completed (step S29). When the drying is not yet completed (step S29; NO), the ON state of the drying apparatus 27 is maintained and the judgment of step S29 is repeated.

When the drying of all unit regions ar is completed (step S29; YES), the drying apparatus 27 is turned OFF and the string of drawing processing ends.

As described above, according to the present embodiment, the nail T with a specific unit region on which drawing is not performed yet and the adjacent unit regions ar are all at least either a dried unit region ar in which ink is applied and the drying of the ink is completed or non-drawn unit region ar on which ink is not applied is specified as the nail T to be positioned in the drawing position and drawing is performed in the unit region ar (specific unit region) of the nail T positioned in the drawing position according to the above specification.

With this, when the nail design is drawn on the plurality of finger nails T, it is possible to prevent the ink mixing in the boundaries of regions drawn with different ink without the user having to judge the drying state of the ink, etc. and highly fine nail print can be performed.

The control unit 81 judges the region where ink does not get mixed and determines the next drawing region. Therefore, it is possible to make the standby time waiting for the ink to dry as short as possible. With this, fast drawing processing can be achieved while maintaining the quality of drawing.

According to the present embodiment, the nail information detecting unit 812 detects the shape of the nail T positioned in the drawing position and judges whether the correct nail T specified by the nail specifying unit 813 is positioned in the drawing position based on the shape of the nail T detected by the nail judging unit 814. When the nail T positioned in the drawing position is not the nail T specified by the nail specifying unit 813, it is displayed on the display unit 26. Therefore, the user is able to realize that the wrong finger is inserted in the finger inserting unit 31 before drawing starts and it is possible to prevent drawing on the nail T with undried regions by mistake.

The drying notifying timer 83 counts the elapsed time from the start of drying and notifies the progress of the drying time. Therefore, only the unit region ar in which the drying time passed is reliably set as the dried unit region ar, and the judgment of the unit region ar on which drawing can be performed can be accurately performed.

The drawing unit 40 includes the writing tool 41 with a tip which comes into contact with the surface of the nail T and performs drawing. Therefore, drawing which is not transparent is possible, and drawing can be performed using ink including color material with large particle size or glitter as used in commercially available manicure or ink with high viscosity. With this, the degree of freedom of the type of ink which can be used in the nail print apparatus 1 is larger than, for example, an ink-jet type printer. When such type of ink is used, the ink does not dry easily and drying takes time, and when the applied ink come into contact with each other, the ink easily becomes mixed. According to the present embodiment, the specific unit region which is the drawing target is a region where all adjacent unit regions ar are at least the dried unit region ar in which the ink is applied and the drying is completed or the non-drawn unit region ar in which ink is not yet applied. Therefore, the blur of the image due to the ink mixing can be prevented while performing the drawing processing efficiently and quickly.

Embodiments of the present invention are described above. However, the present invention is not limited to the embodiments described above, and various modifications are possible without leaving the scope of the present invention.

For example, according to the present embodiment, the configuration including four writing tools 41 in the drawing unit 40 is described but the number of writing tools 41 provided in the drawing unit 40 is not limited to the above.

A standby space where the writing tool 41 stands by can be provided so that a plurality of writing tools 41 stands by in the standby space and the writing tool 41 held in the carriage can be suitably replaced while drawing. In this case, a plurality of types of writing tools 41 can be used for drawing even if only 1 carriage is provided in the drawing unit 40.

According to the present embodiment, the drawing unit 40 includes only the writing tool 41. However, the configuration of the drawing unit is not limited to the above.

For example, in addition to the writing tool 41, the drawing unit can include an ink-jet type drawing head.

In this case, for example, after the drawing processing (drawing and drying) using the writing tool 41 is complete for all nails T, drawing using the ink-jet type drawing head is performed.

When the apparatus includes the ink-jet type drawing head other than the writing tool 41, fine designs can be drawn with the ink-jet type drying head after applying the background color with the writing tool 41, and the variety of the nail design which can be drawn becomes even wider.

According to the present embodiment, the nail print apparatus includes a nail judging unit 814 which judges whether the nail T positioned in the nail inserting unit 31 is the nail T instructed by the nail specifying unit 813. However, the nail judging unit 814 does not need to be provided, and the drawing processing can be performed assuming that the user followed the instructions of the nail specifying unit 813 when the nail T is positioned in the finger inserting unit 31.

According to the present embodiment, a solenoid is used as the writing tool raising/lowering mechanism to move the writing tool 41 up and down. However, the writing tool raising/lowering mechanism is not limited to the above. For example, a step motor, a DC motor, a motor, a ball screw or the like can be used.

According to the present embodiment, the X-direction moving stage 45 and the Y-direction moving stage 47 to move the drawing head 42 is composed of a combination of the X-direction moving motor 46 and the Y-direction moving motor 48 which are step motors and ball screws and guides which are not shown. However, the configuration to move the drawing head 42 is not limited to the above.

The X-direction moving motor 46 and the Y-direction moving motor 48 can be any mechanism which can freely move the drawing head 42 forward, backward, left and right. For example, a mechanism using a shaft, a guide, a wire and the like used in conventional low cost printers can be used or a servo motor can be used.

According to the present embodiment, the drawing data generating unit 815 performs curve correction of the image data of the nail design to generate the drawing data. However, the drawing data generating unit 815 generating the drawing data is not a necessary feature of the present invention. For example, the drawing control unit 816 can suitably convert the image data of the nail design with the LUT (Lookup Table) and output the image data to the drawing head to perform drawing which matches to the nail shape without separately generating drawing data.

According to the present embodiment, the shape of the nail T is detected as the nail information and the drawing data is generated based on the above. However, detecting the nail shape is not a necessary feature of the present invention. For example, when the outline of the nail T does not have to be extracted to perform the drawing, such as drawing a small design in the middle of the nail T, the shape of the nail T does not have to be accurately understood and the drawing can be performed without detecting the nail shape.

Although various exemplary embodiments have been shown and described, the invention is not limited to the embodiments shown. Therefore, the scope of the invention is intended to be limited solely by the scope of the claims that follow and its equivalents.

What is claimed is:

1. A drawing apparatus comprising:

a drawing unit which applies ink to a drawing target region to perform drawing, the drawing target region is a surface of a plurality of nails of a plurality of fingers of a hand or a foot; and a control unit which controls the drawing unit to perform the drawing on the drawing target region, wherein, in the drawing target region, at least any one of the plurality of nails includes a plurality of unit regions which are in contact with each other in at least one portion;

each of the two unit regions in contact with each other is a region to be drawn with ink in different colors; and the control unit includes:

a nail specifying unit which, after the drawing unit applies ink to at least one unit region in the drawing target region, judges whether each of the plurality of unit regions is a dried unit region in which drying of the applied ink is completed, a non-dried unit region in which drying of the applied ink is not completed, or a non-drawn unit region in which the ink is not applied; extracts a specific unit region from the plurality of unit regions, wherein the specific unit region is the non-drawn unit region which are not in contact with the non-dried unit region; and specifies the nail including the specific unit region as a specific nail; and a drawing control unit which controls the drawing unit to perform the drawing on the specific unit region in the specific nail.

2. The drawing apparatus according to claim 1, wherein, the control unit repeats the operation of extracting the specific unit region, specifying the specific nail and controlling the drawing unit to perform the drawing on the specific unit region until all of the plurality of unit regions are judged to be the dried unit region.

3. The drawing apparatus according to claim 1, wherein, when the specific unit region is not extracted from the plurality of unit regions, the control unit repeats search of the specific unit region in the plurality of unit regions until the specific unit region is extracted.

4. The drawing apparatus according to claim 1, wherein, each of the plurality of unit regions is a region drawn with a single type of ink.

5. The drawing apparatus according to claim 1, wherein, the drawing unit includes a drawing tool which comes into contact with the drawing target region to perform the drawing.

6. The drawing apparatus according to claim 1, further comprising:

a display unit; and a finger inserting unit in which one of the fingers can be inserted and the nail of the inserted finger can be positioned in a drawing position where the drawing by the drawing unit can be performed, wherein, the control unit includes a display control unit which displays on the display unit a message to urge inserting of a specific finger of a hand or a foot including the specific nail in the finger inserting unit.

7. The drawing apparatus according to claim 6, wherein, the control unit includes:

a nail information detecting unit which detects a shape of the nail positioned in the drawing position; and a nail judging unit which judges whether the nail positioned in the drawing position is the specific nail based on the shape of the nail detected by the nail information detecting unit, wherein, the display control unit displays on the display unit a message to urge inserting of the specific finger in the finger inserting unit when the nail judging unit judges that the nail positioned in the drawing position is not the specific nail.

8. The drawing apparatus according to claim 1, wherein, drying time required for completion of drying of the ink applied to the unit region is set for each unit region previously;

the control unit includes a drying notifying timer which notifies when elapsed time from when the drawing by the drawing unit in each unit region ends reaches the drying time set for the unit region; and the nail specifying unit judges that the unit region which is notified by the drying notifying timer as reaching the drying time is judged to be the dried unit region.

9. The drawing apparatus according to claim 1, wherein, each of the plurality of unit regions is assigned a different area number in advance;

the nail specifying unit includes information of the area number of each unit region in contact with each other as surrounding relation information; and the finger specifying unit obtains the area number of the unit region in contact with each unit region based on the surrounding relation information and judges whether the unit region with the obtained area number is the dried unit region, the non-dried unit region or the non-drawn unit region.

10. The drawing apparatus according to claim 9, wherein, the nail specifying unit includes information showing priority order of the drawing for each area number as priority order information; and the nail specifying unit judges whether the unit region in contact with each unit region is the dried unit region, the non-dried unit region or the non-drawn unit region in order based on the priority order information.

11. A drawing method of a drawing apparatus including:

wherein the drawing apparatus comprising a drawing unit which applies ink to a drawing target region to perform drawing, the drawing target region is a surface of a plurality of nails of a plurality of fingers of a hand or a foot, wherein, in the drawing target region, at least any one of the plurality of nails includes a plurality of unit regions which are in contact with each other in at least one portion; and each of the two unit regions in contact with each other is a region to be drawn with ink in different colors, judging, after the drawing unit applies ink to at least one unit region in the drawing target region, whether each of the plurality of unit regions is a dried unit region in which drying of the applied ink is completed, a non-dried unit region in which drying of the applied ink is not completed, or a non-drawn unit region in which the ink is not applied;

extracting a specific unit region from the plurality of unit regions, wherein the specific unit region is the non-drawn unit region which are not in contact with the non-dried unit region;

specifying the nail including the specific unit region as a specific nail; and controlling the drawing unit to perform the drawing on the specific unit region in the specific nail.

12. The drawing method of the drawing apparatus according to claim 11, wherein, the operation of extracting the specific unit region, specifying the specific nail and controlling the drawing unit to perform the drawing on the specific unit region by the drawing unit is repeated until all of the plurality of unit regions are judged to be the dried unit region.

13. The drawing method of the drawing apparatus according to claim 11, wherein, in extracting the specific unit region, when the specific unit region is not extracted from the plurality of unit regions, searching of the specific unit region in the plurality of unit regions is repeated until the specific unit region is extracted.

14. The drawing method of the drawing apparatus according to claim 11, wherein, the drawing apparatus further includes, a display unit; and a finger inserting unit in which one of the fingers can be inserted and the nail of the inserted finger can be positioned in a drawing position where the drawing by the drawing unit can be performed, and the drawing method further includes, displaying on the display unit a message to urge inserting of a specific finger of a hand or a foot including the specific nail in the finger inserting unit.

15. The drawing method of the drawing apparatus according to claim 14, the method further comprising:

detecting a shape of the nail positioned in the drawing position;

judging whether the nail positioned in the drawing position is the specific nail based on the shape of the detected nail; and displaying on the display unit a message to urge inserting of the specific finger in the finger inserting unit when it is judged that the nail positioned in the drawing position is not the specific nail.

16. The drawing method of the drawing apparatus according to claim 11, wherein, drying time required for completion of drying of the ink applied to the unit region is set for each unit region previously, and the method further comprising:

counting elapsed time from when the drawing in each unit region ends;

outputting a signal to notify that the elapsed time reached the drying time set for each unit region; and judging that the unit region which is notified as reaching the drying time is the dried unit region.

17. The drawing method of the drawing apparatus according to claim 11, wherein, each of the plurality of unit regions is assigned a different area number in advance; and the drawing apparatus includes information of the area number of each unit region in contact with each other as surrounding relation information, the method further comprising:

obtaining the area number of the unit region in contact with the specific unit region based on the surrounding relation information; and judging whether the unit region with the obtained area number is the dried unit region, the non-dried unit region or the non-drawn unit region.

18. The drawing method of the drawing apparatus according to claim 17, wherein, the drawing apparatus includes information showing priority order of the drawing for each area number as priority order information; and the method further comprising:

judging whether the unit region in contact with each unit region is the dried unit region, the non-dried unit region or the non-drawn unit region in order based on the priority order information.

* * * * *